US005359517A

United States Patent [19]

Moriya et al.

[11] Patent Number: 5,359,517

[45] Date of Patent: Oct. 25, 1994

[54] METHOD AND DEVICE FOR AUTOMATING OPERATION OF CONSTRUCTION MACHINE

[75] Inventors: Yukio Moriya, Hayamamachi; Fujitoshi Takamura, Hirakata; Takumi Onoda, Kawasaki, all of Japan

[73] Assignee: Kabushiki Kaisha Komatsu Seisakusho, Tokyo, Japan

[21] Appl. No.: 853,716

[22] PCT Filed: Dec. 12, 1989

[86] PCT No.: PCT/JP89/01245

§ 371 Date: Jun. 5, 1992

§ 102(e) Date: Jun. 5, 1992

[87] PCT Pub. No.: WO91/09183

PCT Pub. Date: Jun. 27, 1991

[51] Int. Cl.[5] ..... G06F 15/20

[52] U.S. Cl. ..... 364/424.07; 364/167.01; 364/193; 172/4.5

[58] Field of Search ..... 364/424.07, 167.01, 364/180, 193; 37/DIG. 1, DIG. 20; 172/2, 4, 4.5

[56] References Cited

U.S. PATENT DOCUMENTS

| | | | |
|---|---|---|---|
| 4,288,196 | 9/1981 | Sutton, II | 172/4.5 |
| 4,803,640 | 2/1989 | Mitomi et al. | 364/193 |
| 5,003,237 | 3/1991 | Kimura | 364/193 |
| 5,065,326 | 11/1991 | Sahm | 364/424.07 |
| 5,088,020 | 2/1992 | Nishida et al. | 364/167.01 |
| 5,170,342 | 12/1992 | Nakamura et al. | 364/424.07 |
| 5,224,033 | 6/1993 | Nakamura et al. | 364/180 |

FOREIGN PATENT DOCUMENTS

| | | |
|---|---|---|
| 55-105034 | 8/1980 | Japan . |
| 59-220534 | 12/1984 | Japan . |
| 60-33940 | 2/1985 | Japan . |

*Primary Examiner*—Gary Chin

*Attorney, Agent, or Firm*—Richards, Medlock & Andrews

[57] ABSTRACT

An operator's actions for achieving a desired operation of a machine's actuator can be memorized in a teaching mode and the memorized information can be used for automatically reproducing the desired operation in a play back mode, to alleviate the operator's burden. A failure in the play back mode caused by the difference in the conditions under which the play back mode and the teaching mode are conducted can be eliminated, and the operation can be allowed to be continued in the manual mode even if a failure occurs in an automated operation control system. In order to achieve these, when a correction operation by the operator is detected in the play back mode, the play back mode is interrupted and the correction operation is processed with priority to the play back operation. Such correction operation is implemented by a correction signal priority circuit provided on a signal path from a signal converting device for converting the operator's operation into an electrical signal and an electronic controller for interrupting reading-out of the teaching operation data from the memory and for inputting the operator's operation to the electronic controller.

14 Claims, 4 Drawing Sheets

METHOD AND DEVICE FOR AUTOMATING OPERATION OF CONSTRUCTION MACHINE

FIELD OF THE INVENTION

The present invention relates to an operation automating method and a device therefor which are used in hydraulic driven machines such as construction machines to operate an actuator automatically and repetitively in the manner the operator teaches in a first operation and thereby achieve reduction in operator's fatigue and improvement in operability. In particular, the present invention pertains to an operation automating method and a device therefor which are so improved that they allow the operator to conduct a correction operation while the operation conducted in the play back mode is being suspended when the conditions for the operations conducted in the play back mode greatly differ from those for the teaching mode.

BACKGROUND OF THE INVENTION

Development of electronic technologies in recent years is remarkable, and in the fields of hydraulic driven machines, electronic/hydraulic control has been replacing the mechanical control. The electronic/hydraulic control of this type has a high degree of freedom and is inexpensive even when the control is a complicated one. Also, the electronic/hydraulic control is capable of controlling the hydraulic driven machine by the teaching/play back operation. FIG. 4 shows an example of such a control device. When a manual controller 24 is operated, it outputs an operation signal to a control device 23, which is turn operates an electrical/hydraulic valve 22 in accordance with the operation signal so as to couple a hydraulic cylinder 21 to a hydraulic source and thereby operate the hydraulic cylinder 21 by means of a pressure oil supplied from the hydraulic source. When the play back operation of the hydraulic cylinder 21 is to be performed, a predetermined play back instruction signal is given to the control device 23 to call the operation signal stored in a memory device 25 to the control device 23. The control device 23 operates the electrical/hydraulic valve 22 in accordance with that operation signal.

However, the conventional teaching/play back control device of the above-described type has a drawback in that a precise play back operation cannot be performed when the conditions for the teaching operation differ from those for the play back operation, particularly, when the conditions are changed in such a way that a higher output is required during the play back operation. For example, in the case of a teaching/play back control device which is applied to a power shovel, if the soil dug during the play back operation is harder than that dug during the teaching operation, the discharge rate of a hydraulic pump may decrease so as to maintain the power of the hydraulic pump to a substantially fixed value. This may decrease the machine operation speed and generate errors in a subsequent operation because in this teaching/play back system the play back control is performed on a time basis, preventing precise operation from being conducted. Also, in the above-described conventional technique, when the errors of the teaching mode are noticeable, complicated operations are required, including switching over of the operation mode to the normal operation mode, manual correction, and switching over of the operation mode to the play back mode again. Also, in a case where a failure occurs in an electric system of this teaching/play back system, it is impossible to operate the hydraulic cylinder, causing cessation of the operation or deviation of the teaching operation from the play back operation due to the errors in the control device.

SUMMARY OF THE INVENTION

An object of the present invention is to provide an operation automating method and a device therefor for a construction machine which enable the operator to continue operation of a construction machine in the teaching mode or manual operation mode even if a failure occurs in a play back operation control system during the automatic operation in the play back mode. Another object of the present invention is to provide an operation automating method and a device therefor for a construction machine which enable the operator to suspend the automated play back operation and perform a correction operation by a correction signal given by the operator when the play back operation deviates from the teaching operation or when it is desired to finish the automated operation and which allow the operator to automatically restart the play back automated operation when the correction operation is completed.

In order to achieve the aforementioned objects, the present invention provides an operation automating method for a construction machine which includes the teaching mode in which the instructions of the operator are stored in a memory and the play back mode in which the same operation as that stored in the teaching mode is repeated. When the operator performs the correction operation during the play back mode, the play back operation is interrupted to give the correction operation priority. When the correction operation is suspended, the play back mode is automatically restarted. The present invention also provides an operation automating device for a construction machine which includes a memory for storing an operator's instruction signal, an electronic controller to which the signal in the memory is inputted through a correction signal priority circuit, an operating machine actuator controlled by the signal of the electronic controller, and an operating machine operated by the actuator. A correction operation signal has priority to the signal in the memory in the electronic controller.

In the present invention, when the operator designates the teaching mode and then operates a machine lever, the operating machine is controlled by a hydraulic device in accordance with an operation signal. Concurrently with this, the operation signal is stored in the memory of the automating controller. When the operation mode is switched over to the play back mode and the operation is started, the operation signal stored in the memory of the automating controller is inputted to the control valve and the operating machine is thereby controlled in the same manner as that in which it is operated in the teaching mode. The operating machine repeats the operation which corresponds to the operation signal of the lever while the operation mode is in the play back mode. During the operation performed in the play back mode, if the operator operates the lever and thereby sends a correction signal to the automating controller, the correction signal priority circuit in the automating controller cuts the operation signal from the memory and only the correction signal is inputted to the electronic controller. Consequently, the play back operation is interrupted, and the correction operation is conducted. When the correction operation is completed, the play back operation is started again from the point where it has been interrupted because of the absence of the correction signal.

Thus, in the present invention, even if a failure occurs in a play back operation control system during the automatic operation in the play back mode, that operation can be continued in the teaching mode or manual operation mode. When the play back operation deviates from the teaching operation or when it is desired to finish the automated operation, the automated play back operation can be suspended by a correction signal given by the operator and a correction operation can be performed thereafter. The play back automated operation can be automatically restarted when the correction operation is completed.

DESCRIPTION OF THE PREFERRED EMBODIMENTS

Embodiments of the present invention will be described below with reference to the accompanying drawings.

Figure 1:
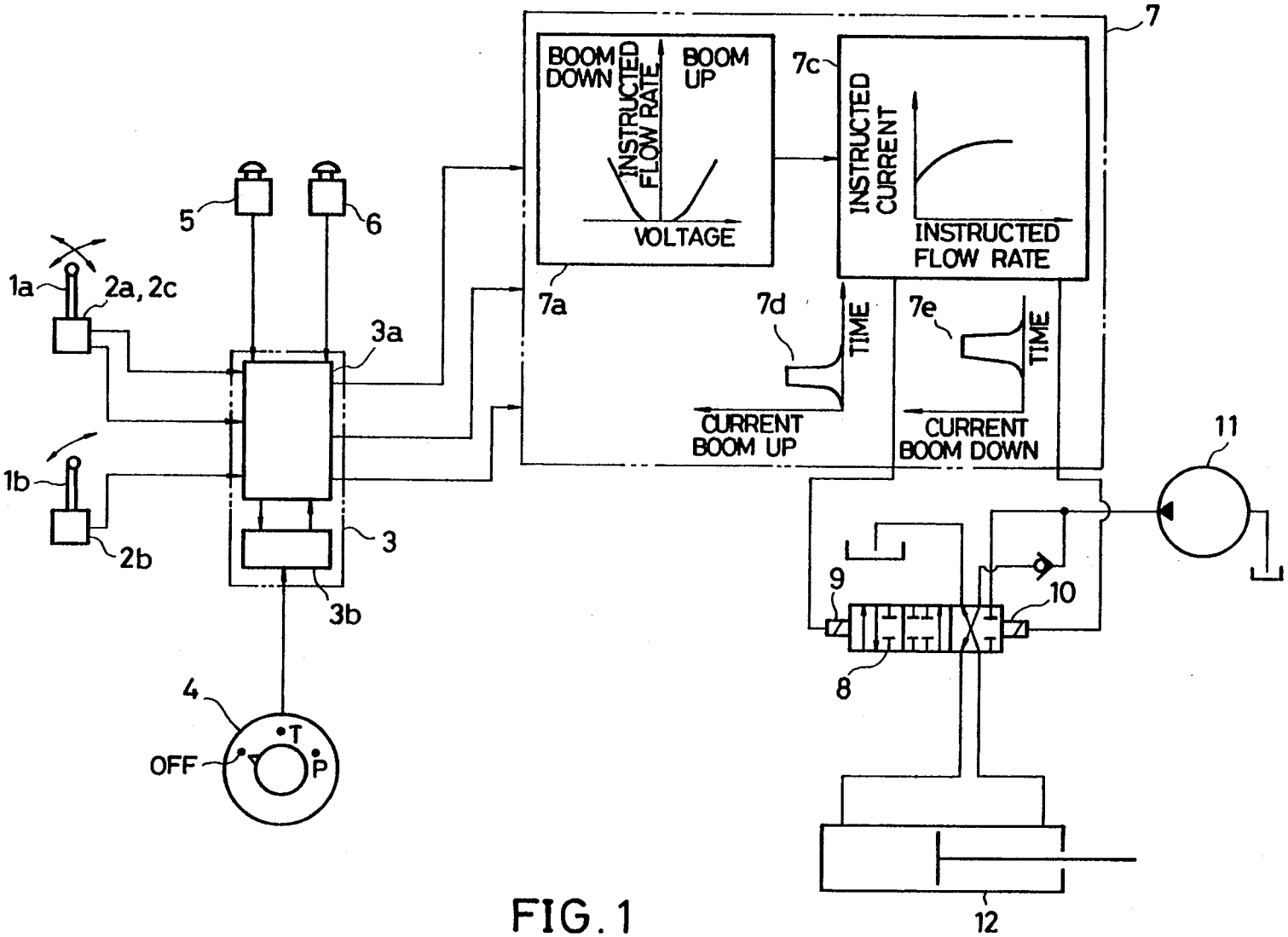
FIG. 1 is an electric/hydraulic circuit showing a first embodiment of the present invention.

FIG. 1 is a circuit diagram of an electric/hydraulic circuit of a hydraulic excavator to which an operation automation method and a device therefor for use in a construction machine according to the present invention are applied, showing a first embodiment of the present invention. Reference numerals 1*a* and 1*b* denote right and left operation levers. The operation of the operation levers 1*a* and 1*b* is converted to an electric signal by conversion devices 2*a*, 2*b* and 2*c*. The operation of the operation levers 1*a* and 1*b* is obtained in the form of a value obtained when the operation lever la is operated in a direction perpendicular to the conversion device 2*a*. An automation controller 3 outputs to an electronic controller 7 a signal corresponding to the signals inputted to the automation controller 3 from a mode switch 4, a teaching switch 5 or a play back switch 6. The electronic controller 7 outputs a signal corresponding to the signal inputted thereto from the automation controller 3 to solenoids 9 and 10 which control an electronic hydraulic valve 8. Consequently, the electronic hydraulic valve 8 is operated in accordance with the operation of the operation levers 1*a* and 1*b* to supply an oil discharged by a hydraulic pump 11 to a cylinder 12 in an amount corresponding to the operation of the hydraulic valve 8. The operation signal of the right and left operation levers 1*a* and 1*b* is inputted to the electronic controller 7 in the form of a voltage. This voltage and the flow rate of an oil flow to the cylinder 12 has a relation indicated by a graph 7*a*. The flow rate of an oil flow to the cylinder 12 and a current has a relation shown by a graph 7*c*. As a result, the operation signal of the operation levers 1*a* and 1*b*, which is inputted to the electronic controller 7, is outputted to the solenoids 9 and 10 of the electronic hydraulic valve 8 in the form of a current shown in 7*d* and 7*e*. The automation controller 3 includes a correction signal priority circuit 3*a* and a memory 3*b*. The automation controller 3 cuts the outputting of the signal stored in the memory 3*b* to the electronic controller 7 and outputs a correction signal when the correction signal is inputted thereto from the operation levers 1*a* and 1*b* in the play back mode.

Figure 2:
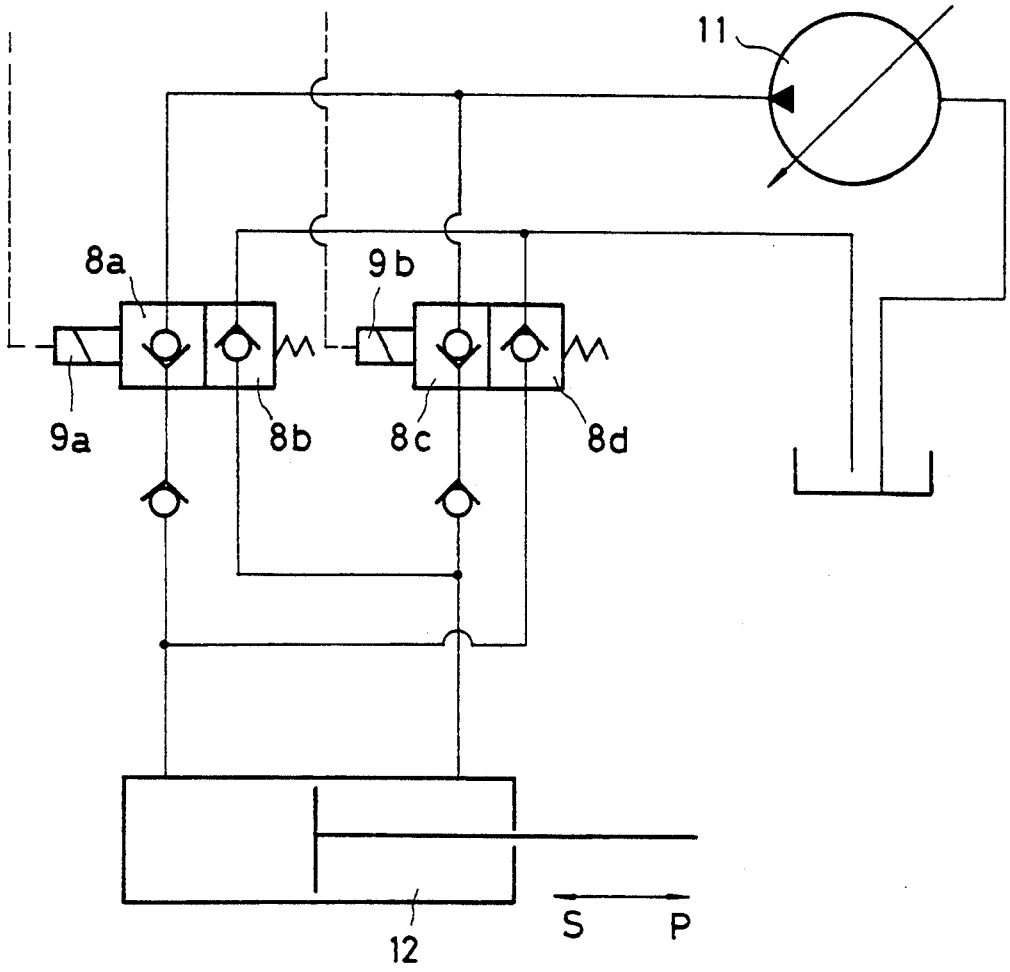
FIG. 2 is an electric/hydraulic circuit showing a second embodiment of the present invention; of FIG. 1.

FIG. 2 shows a second embodiment of the present invention which employs electronic poppet valves 8*a* to 8*d* in place of the electronic hydraulic valve 8 shown in FIG. 1. When the same signal inputted to the solenoid 9 shown in FIG. 1 is inputted to a solenoid 9*a*, the meter-in poppet valve 8*a* and the meter-out poppet valve 8*b* are opened, and the poppet valve 8*b* is opened to control the amount of oil exhausted from the cylinder 12. Hence, a rod of the cylinder 12 moves in a direction indicated by the arrow P at a speed corresponding to the signal inputted to the solenoid 9*a*. Also, when the same signal as that inputted to the solenoid 10 shown in FIG. 1 is inputted to a solenoid 9*b*, the meter-in poppet valve 8c and the meter-out poppet valve 8*d* are opened and the rod of the cylinder 12 thus moves similarly in a direction indicated by the arrow S.

The embodiments shown in FIGS. 1 and 2 employ a single cylinder 12 and a single electronic hydraulic valve 8. It is however to be noted that a number of such hydraulic devices correspond to a number of operating machines.

The operation of the operation automating device for a construction machine arranged in the manner described above will be described.

(1) Teaching operation

When the mode switch 4 is positioned to the teaching mode T and the teaching switch 5 is turned on, the electrical signals 2*a*, 2*b* and 2*c*, corresponding to the operation of the right and left operation levers 1*a* and 1*b*, are inputted to the electronic controller 7 through the correction signal priority circuit 3*a*, and the electronic hydraulic valve 8 is thereby controlled to operate the cylinder 12, by means of which a predetermined operation is performed. Concurrently with this, the operation of the right and left operation levers 1*a* and 1*b* is stored in the memory 3*b* of the automation controller 3. After the completion of the operation, the teaching switch 5 is turned off to finish the teaching operation.

(2) Play back operation

After the operating machine is returned to the posture which it is in when the play back operation is started, the mode switch 4 is positioned to the play back mode P and the play back switch 6 is turned on to start the play back operation. The play back operation is repeated until the play back switch 6 is turned off.

When it is desired to perform correction operation in the play back mode in which the signal stored in the memory 3*b* in the teaching mode is outputted to the electronic controller 7 through the correction signal priority circuit 3*a*, the operator inputs a correction signal to the automating controller 3 by operating the operation levers 1*a* and 1*b*. The correction signal priority circuit 3*a* cuts the outputting of the signal stored in the memory 3*b* to the electronic controller 7 and thereby controls the electronic hydraulic valve 8 by the correction signal from the operation levers 1*a* and 1*b* to operate the cylinder 12.

Figure 3:
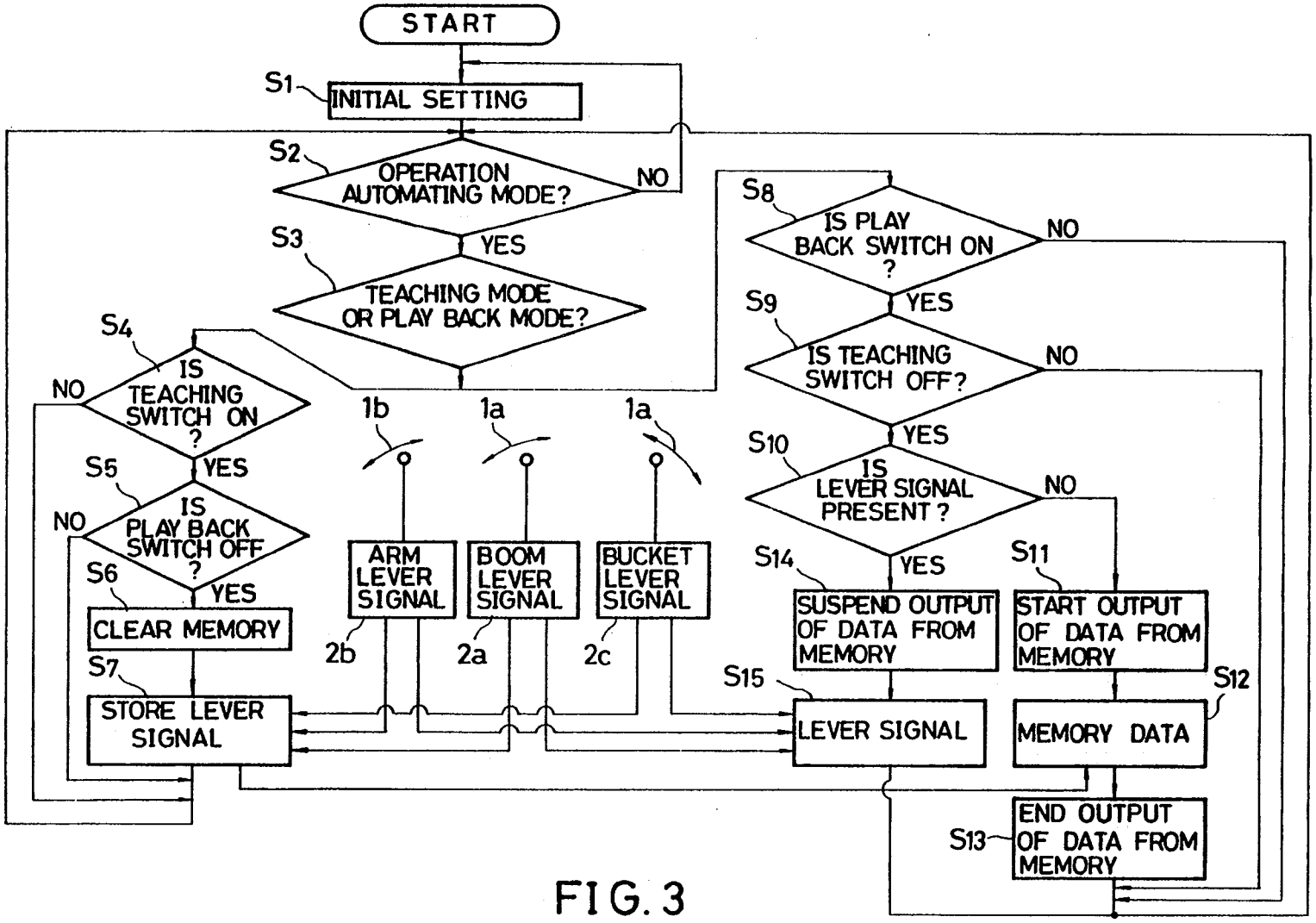
FIG. 3 is a flowchart of the operation of the circuit of FIG. 1.
Figure 4:
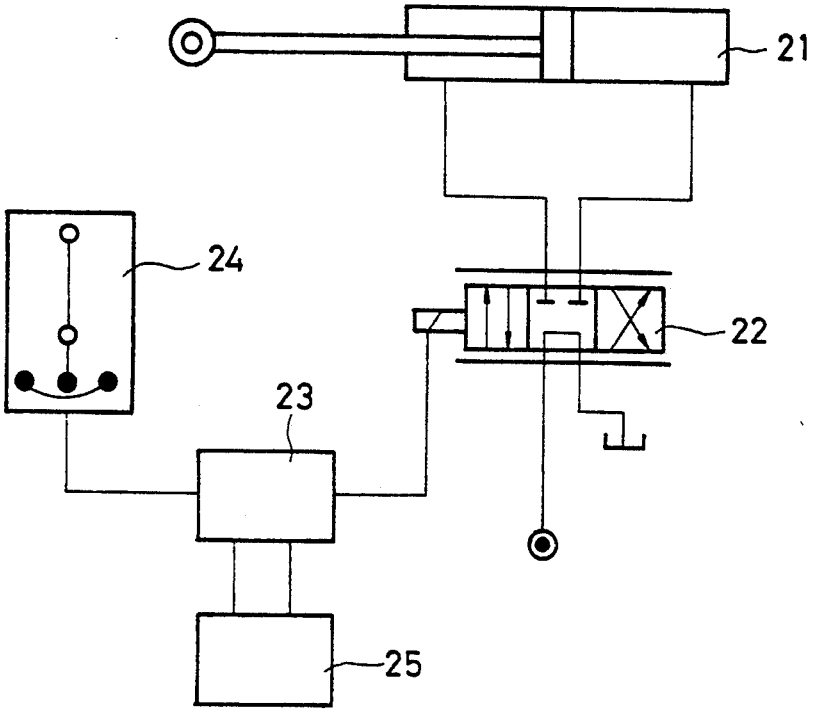
FIG. 4 (PRIOR ART)
FIG. 4 is a schematic circuit diagram of a conventional technique.

FIG. 3 is a flowchart of the operation of the electric/-hydraulic circuit shown in FIGS. 1 and 2. First, initial setting is conducted in step S1. Next, in steps S2 and S3, selection between the normal operation mode, the teaching mode and the play back mode is performed by the mode switch 4. When the teaching mode is selected, the teaching switch 5 is turned on in step S4, and the play back switch 6 is turned off in step S5. Thereafter, in step S6, the memory in the automating controller 3 is cleared, and the signals from the right and left operation levers 1*a* and 1*b* are stored in the memory in the automating controller 3 in step S7. Once the teaching operation using the operation levers 1*a* and 1*b* is completed, the play back switch 6 is turned on in Step S8, and the teaching switch 5 is turned off in step S9. Next, it is determined in step S10 whether or not the correction signal from the operation levers 1*a* and 1*b* is inputted to the correction signal priority circuit 3*a*. If the answer is negative, outputting of the operation stored in the memory 3*a* of the automating controller 3 starts in step S11. Next, in step S12, the operating machine performs the teaching operation on the basis of the memory data. Once the outputting of the data from the memory is completed in step S13, the play back operation is completed. Thereafter, the process returns to step S2 to repeat the same play back operation, if no instruction is given. The play back operation is repeated until the play back switch 6 is turned off in step S8. If it is determined in step S10 that the correction signal from the operation levers 1*a* and 1*b* is inputted to the correction signal priority circuit 3*a*, outputting of the data in the memory 3*b* is suspended while the correction signal is being inputted in step S14, and the electronic controller 7 is then controlled by the correction signal from the operation levers 1*a* and 1*b* to operate the cylinder 12 in step S15.

INDUSTRIAL APPLICABILITY

As will be understood from the foregoing description, the operation automating method and the device therefor according to the present invention can be applied to various types of construction machines such as power shovels, and can be used as the device for operating an operating machine such as a bucket by means of an actuator such as a hydraulic cylinder.

What is claimed is:

1. A method of automating repetitive operations of a machine having an actuator, said method comprising:

in a teaching mode, generating an operation signal for a first operation of said actuator in response to the manual actions of an operator, controlling said actuator responsive to the thus generated operation signal to thereby perform said first operation during the teaching mode, and storing in a memory the thus generated operation signal;

then, in a play back mode, establishing a play back operation control signal responsive to the thus stored operation signal, and controlling said actuator responsive to said play back control operation signal to automatically and repetitively perform a controlled operation of said actuator in the manner of said manual actions of the operator during the teaching mode; and interrupting said play back mode at a time when the conditions for the controlled operation conducted in the play back mode differ from conditions for the first operation conducted in the teaching mode and providing a correction for said controlled operation of said actuator by generating a correction operation signal for said actuator in response to the manual actions of an operator while said play back mode is interrupted, and controlling said actuator responsive to said correction operation signal while said play back mode is interrupted.

2. A method in accordance with claim 1 wherein said play back mode is interrupted automatically by the generation of said correction operation signal for said actuator.

3. A method in accordance with claim 1 wherein said machine is a construction machine.

4. A method in accordance with claim 1 wherein the step of controlling said actuator responsive to either said play back control operation signal or said correction operation signal comprises controlling a valve located in a fluid supply line to said actuator to thereby vary the supply of fluid to said actuator.

5. A method in accordance with claim 1, further comprising resuming the step of controlling said actuator responsive to said play back control operation signal upon the termination of said correction operation signal.

6. A method in accordance with claim 1 wherein the interrupting of said play back mode is achieved by giving priority to said thus generated correction operation signal over said play back control operation signal.

7. A method in accordance with claim 6 wherein the step of controlling said actuator responsive to either said play back control operation signal or said correction operation signal comprises controlling a valve located in a fluid supply line to said actuator to thereby vary the supply of fluid to said actuator.

8. A method in accordance with claim 7, further comprising resuming the step of controlling said actuator responsive to said play back control operation signal upon the termination of said correction operation signal.

9. A method in accordance with claim 8 wherein said machine is a construction machine.

10. Apparatus for automating repetitive operations of a machine having an actuator, said apparatus comprising:

a signal conversion device for converting an operator's manual operation of the signal conversion device into an electrical operation signal for said actuator, said electrical operation signal being representative of the manner of the manual operation of the signal conversion device by the operator;

a memory for storing the thus generated electrical operation signal;

an operations device for operating said actuator;

an electronic controller connected to said signal conversion device, to said memory, and to said operations device, for passing said thus generated electrical operation signal to said memory in a teaching mode, for passing a signal corresponding to the thus stored electrical operation signal to said operations device in the absence of the generation of an electrical operation signal by said signal conversion device during a play back mode to thereby cause said operations device to automatically and repetitively operate said actuator during the play back mode in the manner of the manual operation of the signal conversion device by the operator during the teaching mode, and for interrupting the passing of said signal corresponding to the thus stored electrical operation signal to said operations device in response to an operator's manual operation of the signal conversion device to produce a correction electrical operation signal during the play back mode and passing a signal corresponding to said correction electrical operation signal to said operations device when said correction electrical operation signal is generated while the play back mode is interrupted.

11. Apparatus in accordance with claim 10 wherein said electronic controller comprises a correction signal priority circuit which automatically interrupts the passing of said signal corresponding to the thus stored electrical operation signal to said operations device during the play back mode whenever said correction electrical operation signal is generated during the play back mode, and which automatically begins the passing of the signal corresponding to said correction electrical operation signal to said operations device when said correction electrical operation signal is generated during the play back mode.

12. An apparatus in accordance with claim 11 wherein said operations device comprises a valve located in a fluid supply line to said actuator, and means for controlling said valve to thereby vary the supply of fluid to said actuator.

13. An apparatus in accordance with claim 12 wherein said machine is a construction machine.

14. An apparatus in accordance with claim 10 wherein said operations device comprises a valve located in a fluid supply line to said actuator, and means for controlling said valve to thereby vary the supply of fluid to said actuator.

* * * * *